US005580620A

United States Patent [19]

Campbell et al.

[11] Patent Number: 5,580,620

[45] Date of Patent: Dec. 3, 1996

[54] MULTIPLE VOID LAYER SYNTHETIC RESIN PANELS

[75] Inventors: Odene E. Campbell; John M. Plevyak, both of Bloomsburg, Pa.

[73] Assignee: 21st Century Ltd., Bloomsburg, Pa.

[21] Appl. No.: 300,019

[22] Filed: Sep. 2, 1994

[51] Int. Cl.[6] ..... E06B 3/24

[52] U.S. Cl. ..... 428/34; 428/120; 428/166; 428/167; 428/178; 428/188; 428/192; 52/786.11; 52/793.1

[58] Field of Search ..... 428/167, 172, 428/188, 178, 34, 72, 33, 120, 166, 908.8, 192; 52/786.11, 793.1

[56] References Cited

U.S. PATENT DOCUMENTS

| | | | |
|---|---|---|---|
| 690,732 | 1/1902 | Jarvis et al. | 52/395 |
| 2,073,278 | 3/1937 | Hohl | 52/395 |
| 3,127,960 | 4/1964 | Smith et al. | 189/1 |
| 3,460,860 | 8/1969 | Stevens, Jr. | 52/470 |
| 4,305,982 | 12/1981 | Hirsch | 428/34 |
| 4,358,490 | 11/1982 | Nagai | 428/178 |
| 4,495,939 | 1/1985 | Arai | 428/71 |
| 4,565,723 | 1/1986 | Hirsch | 428/178 |
| 4,707,393 | 11/1987 | Vetter | 428/178 |
| 4,796,404 | 1/1989 | Butler | 428/178 |
| 4,889,758 | 12/1989 | Rinkewich | 428/178 |
| 4,897,146 | 1/1990 | Inzinna | 156/462 |
| 4,898,153 | 2/1990 | Sherwood | 126/448 |
| 5,348,790 | 9/1994 | Ben-Zvi et al. | 428/178 |

FOREIGN PATENT DOCUMENTS

| | | |
|---|---|---|
| 0050462A1 | 4/1982 | European Pat. Off. . |
| 1609777 | 4/1970 | Germany . |
| 2212870 | 9/1973 | Germany . |
| 2527013 | 1/1976 | Germany . |
| 676267A5 | 12/1990 | Switzerland . |

OTHER PUBLICATIONS

Klasse B 32, GMA–HEFT5Ovom, Dec. 16, 1982, p. 2256.

GE Plastics Structured Products–LEXAN© Sheet For Architectural Glazing (Sep. 1991).

*Primary Examiner*—Donald Loney

*Attorney, Agent, or Firm*—Panitch Schwarze Jacobs & Nadel, P.C.

[57] ABSTRACT

A light-transmissive panel is provided having a unitary synthetic resin skeletal structure having a continuous length. The panel may be used alone or in a multiple panel structure. The panel structure has first and second exterior plates and at least two spaced apart interior plates located within a space between the first and second plates such that the first, second and interior plates lie in planes generally parallel to each other along the length of the structure and a space is created between each pair of plates. The first, second and interior plates are interconnected by a plurality of walls extending in a direction perpendicular to the planes of the plates forming a plurality of continuous cellular voids extending parallel to the length of the structure. In a multiple panel structure in which two or more juxtaposed panels are joined together by a connector, the first plate of each panel in the structure has two length-wise extending recessed channels. The connector is adapted to releasably engage the channels.

21 Claims, 2 Drawing Sheets

MULTIPLE VOID LAYER SYNTHETIC RESIN PANELS

FIELD OF THE INVENTION

The present invention relates to multiple void layer synthetic resin panels and more particularly to multiple panel systems in which the panels are interconnected by a connector.

BACKGROUND OF THE INVENTION

A common method of maximizing the thermal insulation ability of panels and windows made of glass, glass laminates or plastics is to provide a "dead-air" space between individual panes. Multiple pane glass windows increase the insulating ability of typical glass windows. The thermal resistance, or "R-value" measured in °F.-hr-ft$^2$/Btu, is the mean temperature difference at equilibrium between two defined surfaces of material that induces a unit heat flow rate through a unit area. Heat flow (Q) as measured in Btu/ft$^2$-hr is related to the difference in temperature ($\Delta T$) between the interior and exterior of a window or similar structure roughly in accordance with the following general insulation equation:

$$Q_{heat\ flow}=\Delta T/R$$

Thermal resistance, or R-value, exhibits an inverse relationship to heat flow. Therefore higher R-values, exhibit less heat flow and represent better insulation properties.

For example a single-pane window with an approximate thickness of about ¼ inch has an R-value of about 0.96° F.-hr-ft$^2$/Btu in relation to summer heat gain and an R-value of about 0.88° F.-hr-ft$^2$/Btu in relation to winter heat loss. By providing two panes of glass with an intervening dead-air space of about ½ inch, the R-value is raised to about 1.79 in the summer and about 2.04 in the winter. However, multiple layers of glass significantly add to the weight and cost of a window. In addition, glass typically allows direct, intense light as opposed to a softer diffused light to pass through.

To decrease cost and weight, but to maintain or improve thermal resistance, polymeric/glass laminates and polymeric panels were developed. These laminates and panels typically utilize polymeric structures which have a single layer of void spaces between two plates. Polycarbonate panels, for example LEXAN™ manufactured by General Electric Plastics, at ¼ inch thickness are approximately 90% lighter than glass and have R-values in the range of 1.56 in relation to summer heat gain and 1.54 in relation to winter heat loss. R-values and weight are particularly important in the manufacture of panelized skylights, greenhouses or similar rooms or other window wall structures. In addition, polycarbonate-based panels have the added advantage of an extremely high impact resistance. LEXAN™ polycarbonate sheet has a Notched Izod value at ⅛ inch of from about 12 to 16 ft-lbs/in$^2$.

To further improve the insulation properties of polymeric panels, there have been unsuccessful attempts to make a panel having more than three plates such that more than two layers of void spaces may be provided between the plates. These panels have only two layers of individual voids and little structural integrity due to the large volume of each of the individual void spaces and problems which were encountered in successfully extruding such a panel.

Typically such panels are interconnected by an aluminum framing system. To allow for thermal expansion, space is left within the aluminum frame and the frame is sealed. The panels within the structure are typically manufactured in lengths of up to 12 feet. Aluminum framing is required around each panel and around the periphery of the structure. This represents a significant amount of aluminum framing both for structural support and to compensate for thermal expansion. Such framing has attendant fabrication and raw material costs which are incorporated into the overall cost of a typical synthetic resin panel system. In addition, large amounts of aluminum framing significantly increase the overall weight of the structure which must be supported. These panels also require exterior capping which often leaks.

Therefore a need in the art exists for a synthetic resin panel having improved insulation capability which does not appreciably increase the weight of an individual panel, and the attendant costs of manufacturing. In addition, there is a need for an improved multiple synthetic resin panel system which has sufficient internal structural support and room for thermal expansion without incurring the high fabrication and raw material costs associated with typical aluminum framing systems and which does not require horizontal capping, controls the flow of water and virtually eliminates the potential for water infiltration.

SUMMARY OF THE INVENTION

The present invention comprises a light-transmissive panel comprising a unitary synthetic resin skeletal structure which has a continuous length. The structure comprises a first and second exterior plates, at least two interior plates and a plurality of walls which interconnect the plates. The second plate is generally parallel to and spaced apart from the first plate creating an interior space. The interior plates are generally parallel to and spaced apart from one another. The interior plates are located in the interior space between the first and second plates, such that the first, second and interior plates lie in planes generally parallel to each other along the length of the structure and a space is created between each pair of plates. The plurality of walls which interconnect the plates extend from the first plate to the second plate in a direction generally perpendicular to the planes of the plates, such that the plates and walls intersect to form a plurality of continuous cellular voids. The voids extend parallel to the length of the structure.

The present invention also comprises a multiple panel structure which comprises at least two panels and at least one connector. The panels in the multiple panel structure are in accordance with a preferred embodiment of the panel of the present invention. Portions of the first plate of each panel protrude inwardly into the interior space near a first and second edge of the first plate. The portions of the first plate which protrude inwardly form a first channel near the first edge and a second channel near the second edge of the first plate. The channels extend along the edges of the structure in a direction parallel to the length of the structure. The channels are adapted to receive a connector such that the panel may be connected to at least one adjacent panel juxtaposed to but spaced apart from the panel.

The panels in the multiple panel structure are arranged such that the first edge of the first plate of a first panel is adjacent to but spaced apart from the second edge of the first plate of a second adjacent panel.

The connector of the multiple panel structure comprises a first finger, a second finger and a base member. The first finger is sized to be disposed within the first channel of the first panel such that the first finger is releasably secured within the first channel of the first panel. The second finger is sized to be disposed within the second channel of the second panel such that the second finger is releasably secured within the second channel of the second panel. The base member lies between and interconnects the first finger and the second finger such that the first and second fingers are spaced from each other a distance corresponding to the distance between the first channel of the first panel and the second channel of the second panel when the first and second panels are juxtaposed.

BRIEF DESCRIPTION OF THE DRAWINGS

The foregoing summary, as well as the following detailed description of preferred embodiments of the invention, will be better understood when read in conjunction with the appended drawings. In the drawings, like numerals are used to indicate like elements throughout. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

The present invention answers a need in the art for a multiple void layer panel which significantly improves insulation values without appreciable increase in structural weight over standard synthetic resin insulating panels, and can be manufactured at varying continuous lengths greater than those of the prior art.

In addition, the present invention provides an improved multiple panel structure which comprises an interlocking synthetic resin connector which renders connection points between panels watertight (removing the need for exterior capping), provides drainage and allows for thermal expansion, but does not require a substantial network of aluminum framing between individual panels and virtually eliminates the potential for water infiltration. As such, the present invention reduces the cost of manufacture associated with large amounts of aluminum framing including raw material and fabrication costs. In addition, the connection area between panels provides additional design flexibility and improves the overall appearance of the synthetic resin multiple panel structure.

The present invention also provides a panel having a significantly improved R-value, a significantly higher strength and a very low heat gain as compared to typical glass or polymeric panels.

Figure 1:
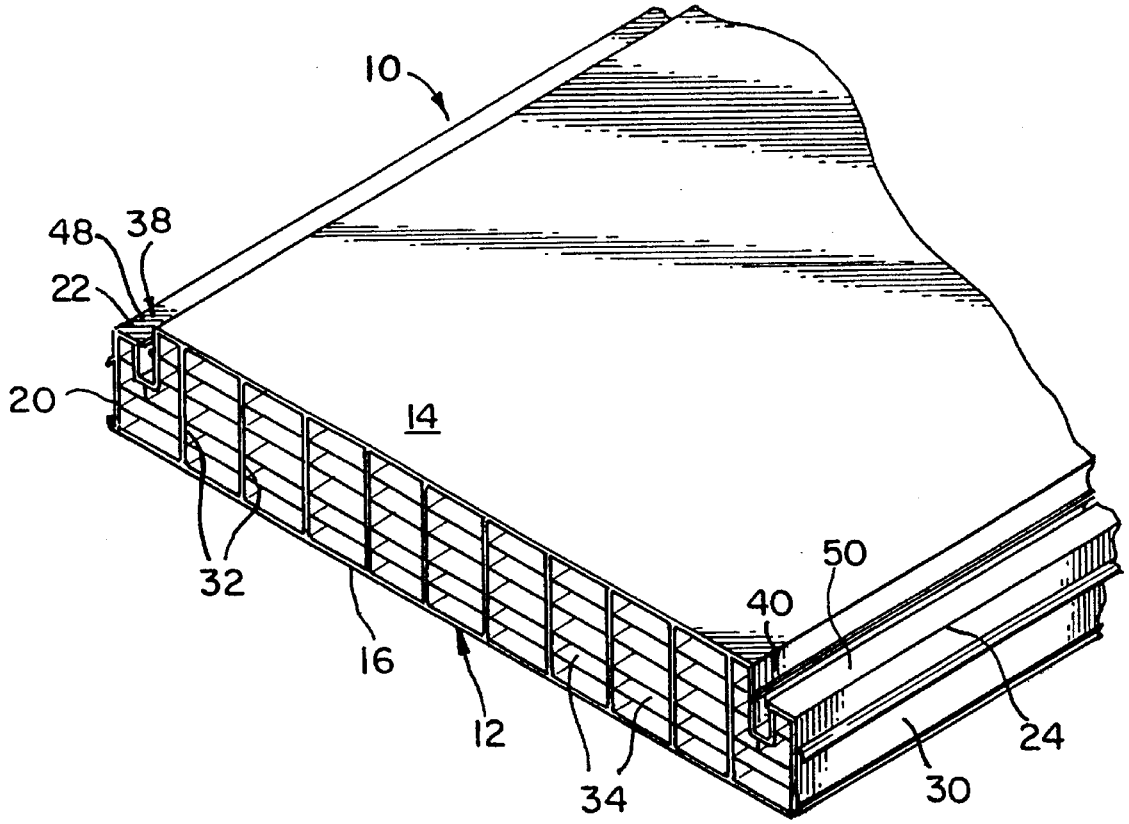
FIG. 1 is a perspective view of a panel in accordance with the preferred embodiment of the present invention.
Figure 3:
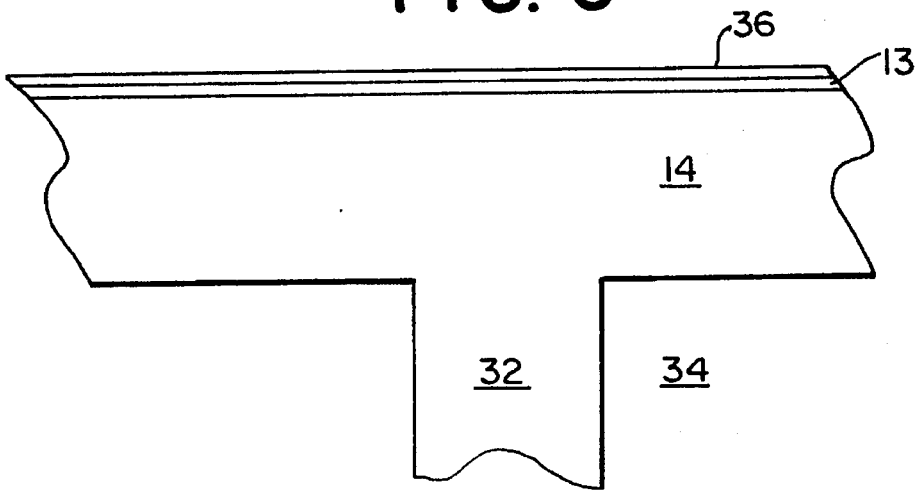
FIG. 3 is an enlarged fragmentary view of a portion of one of the panels in the multiple panel structure shown in FIG. 2.
Figure 2:
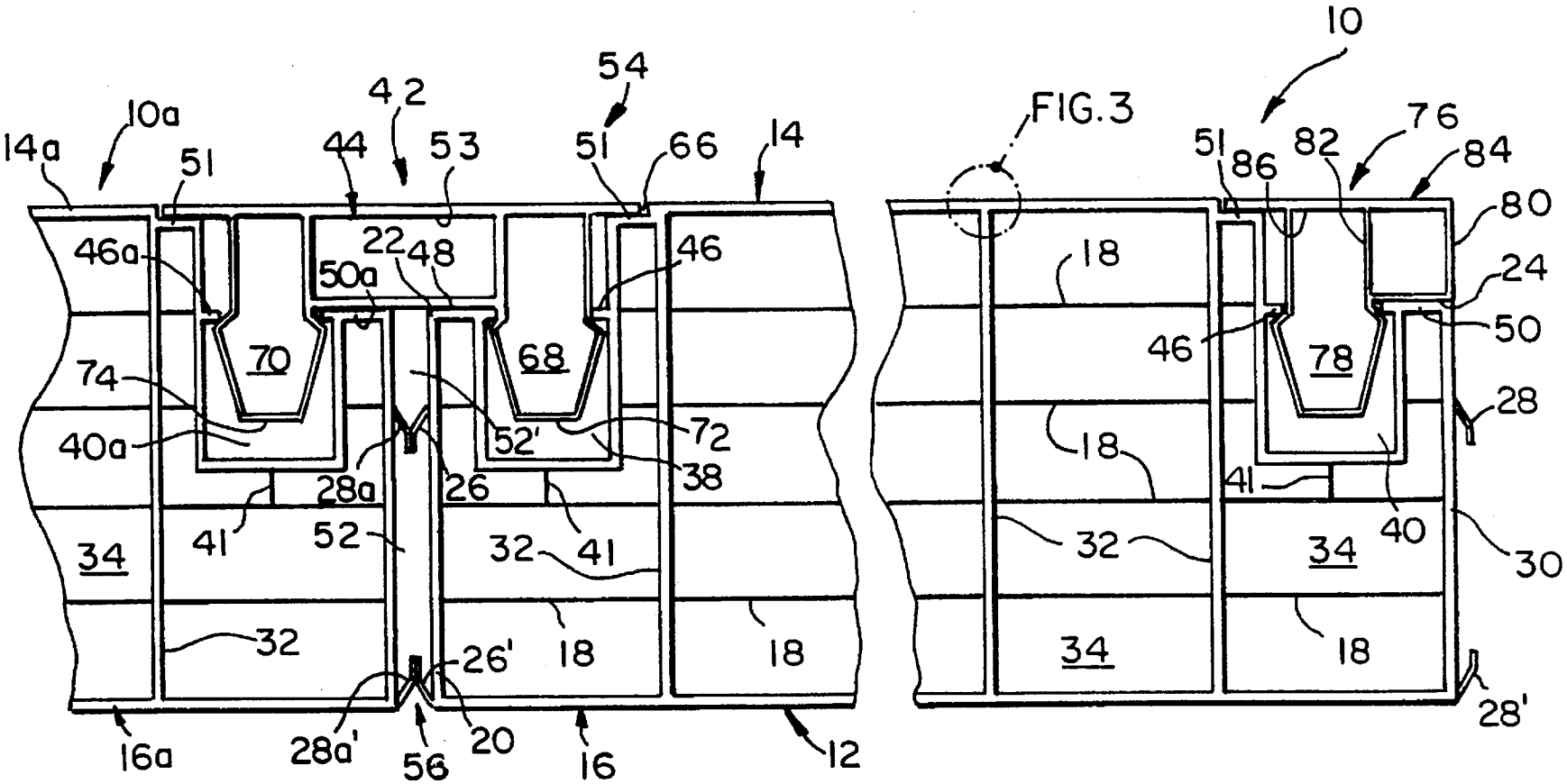
FIG. 2 is a front end elevational view of the panel of FIG. 1 included in a multiple panel structure in accordance with the preferred embodiment of the present invention.

The panel, generally designated 10, is extrusion molded, as described below, into a unitary synthetic resin skeletal structure 12 as shown in FIGS. 1 and 2. The skeletal structure 12 of the panel 10 in the most preferred embodiment of the present invention comprises polycarbonate in order to provide sufficient structural strength to the panel 10. A polycarbonate skeletal structure 12 also provides a panel 10 which is transparent or translucent. However, other synthetic resins such as, for example, homopolymers, copolymers and terpolymers of polystyrene, polyacrylate, polypropylene and polyethylene and homopolymers and copolymers of polyurethane and acrylonitrile-butadiene-styrene may also be used to form the structure 12. If the synthetic resin chosen for the structure 12 lacks sufficient structural integrity, a reinforcing layer 13 as shown in FIG. 3 of polycarbonate or a like resin, for example the resins described above, may be laminated onto the structure 12 in accordance with methods known to those of ordinary skill in the art.

The structure 12 of the panel 10 has a first exterior plate 14, a second exterior plate 16 and at least two interior plates 18. In the preferred embodiment as shown in FIGS. 1 and 2, there are four interior plates 18. The first plate 14, the second plate 16 and the interior plates 18 preferably all lie in planes which are generally parallel to each other along the length of the structure 12.

The panel 10 is preferably continuously extruded to varying lengths of from about 8 feet to about 39 feet as measured longitudinally in a direction parallel to the plane of the first plate 14 along the first side wall 20 of the panel 10. While longer length panels 10 are within the scope of this invention, they are not typically preferred as such lengths are not practical for most construction purposes.

The panel 10 is extruded through a multiple-port die (not shown) in a width corresponding to standard widths for other synthetic resin panels known to those of ordinary skill in the art. The panel 10 of the present invention is preferably manufactured in predetermined widths of up to and including about 24 inches. The width is measured in a transverse direction along the plane of the first plate 14 from the first edge 22 of the plate 14 to the second edge 24 of the plate 14.

The thickness of the panel 10 as measured from the first plate 14 to the second plate 16 in a direction perpendicular to the plane of the first plate 14 of the panel 10 is dependent upon the number of interior plates 18 which are provided. The plates 14, 16, 18 are preferably evenly spaced apart from one another by from about 0.250 inch to about 0.750 inch, more preferably about 0.5 inch as measured in a direction perpendicular to the planes of two adjacent plates 18 of the panel 10 between two facing surfaces of those two adjacent plates 18. The first plate 14 and the second plate 16 preferably have a thickness which is the same or greater than the interior plates 18. Preferably the ratio of the thickness of the first and second plates 14, 16 to the thickness of the interior plates 18 is from about 1:1 to about 7:1. The interior plates 18 are preferably from about 0.005 to about 0.015 inch thick.

The first side wall 20, the second side wall 30 and all of the interior walls 32 preferably have an equivalent width as measured in a direction perpendicular to the side walls 20, 30 transversely along the plane of an interior plate 18. The walls 20, 30 and 32 preferably have a width which is greater than the thickness of the interior plates 18, but less than the thickness of the first and second plates 14, 16. Preferably, the walls 20, 30, 32 have a width of from about 0.025 to about 0.075 inch, more preferably the walls 20, 30, 32 have a width of about 0.05 inch.

The panel 10 preferably has at least two, and more preferably four or more interior plates 18 which intersect with the walls 20, 30, 32 such that at least three, and more preferably five layers of individual void spaces 34 are created which extend longitudinally through the structure 12. In the most preferred embodiment of the present invention, four interior plates 18 are extruded providing five layers of individual void spaces 34. It should be understood by one skilled in the art that the present invention is not limited to any particular number of plates 18 or layers of void spacing 34.

As the panel 10 of the present invention is particularly useful in greenhouse or skylight structures, additional polymeric protectant layers 36 as shown in FIG. 3 may be laminated to the exterior of the first plate 14 of the structure 12 by any method known to those of ordinary skill in the art. Optional protectant layers 36 may be comprised of, for example, homopolymers, copolymers and terpolymers of polyethylene, polypropylene, polyacrylate, polycarbonate, similar polymeric compounds and blends and mixtures thereof. Preferably the additional protectant layers 36 are light-transmissive and help prevent surface scratching or other exterior damage.

In one or more of the protectant layers 36, ultraviolet absorbers or stabilizers which are miscible in the amount chosen within the resin used to form the protectant layer 36 and/or the structure 12 may be added to protect the structure 12 of the panel from harm caused by ultraviolet radiation. Typical ultraviolet absorbers known to those skilled in the art of synthetic resin panels include, for example, 2,4-dihydroxybenzophenone, 2,2',4-trihydroxybenzophenone and 2,2',4,4'-tetrahydroxybenzophenone and derivatives of those compounds; 2,(2'-hydroxy-5'-methylphenyl)benzotriazole and its derivatives; 2,4-dihydroxybenzoylfuran; phenyl salicylate; resorcinol disalicylate, resorcinol monobenzoate and resorcinol dibenzoate; benzyl benzoate; stilbene and betamethylumbelliferone and betamethylumbelliferone benzoate.

In the preferred embodiment of the present invention as shown in FIGS. 1 and 2, the first plate 14 is preferably modified by the extrusion die to partially protrude inwardly through intervening interior plates 18 and void spaces 34 near the first edge 22 and the second edge 24 of the plate 14 such that a first channel 38 and a second channel 40 are created in the panel 10. The first plate 14 should preferably protrude through at least two layers of void spaces 34; however, the extent of protrusion is not critical and may be varied for different panel or connector designs. The first plate 14 should be modified to create substantially rectangular channels 38, 40; however, other geometric configurations such as, for example, elliptical, circular and triangular are within the scope of the invention.

In the preferred embodiment, support walls 41 may be extruded below the channels 38, 40 for further structural integrity; however, such walls 41 are not necessary. In the preferred embodiment shown in FIGS. 1 and 2, the channels 38, 40 are located inwardly from the side walls 20, 30. The first and second channels 38, 40 are preferably adapted to receive a connector 42 shown in FIG. 2.

If the panel 10 comprises channels 38, 40, the first plate 14 is recessed such that the side walls 20, 30 preferably have a depth measured in a direction perpendicular to the plane of the first plate 14 of the panel 10 which is less than the depth of the interior walls 32 of the structure 12 in order to accommodate the base member 44 of the connector 42 and to provide design flexibility between panels **10, 10*a*. The channels 38, 40 may also be located adjacent the side walls 20, 30 or further into the structure 12 depending upon the size of the connector 42 to be used. The first plate 14 in the preferred embodiment preferably comprises protrusions 46 which are parallel to the plane of the first plate 14 of the panel 10 and extend inwardly into the channels 38, 40 level with the portions 48, 50 of the first plate 14 which lie between the first side wall 20 and the channel 38 and the second side wall 30 and the channel 40 respectively. The protrusions 46 are adapted to releasably lock connectors 42 in the channels 38, 40 once the connectors are inserted in the channels 38, 40**.

The first plate 14 preferably decreases in thickness in the area around the channels 38, 40 providing indentations 51 in the first plate 14 adapted to the design of the connector 42 as described below.

The panel 10 in the preferred embodiment further comprises a first pair of bent fins 26, 26' and a second pair of bent fins 28, 28' which extend outwardly from the first side wall 20 and the second side wall 30 respectively as shown in FIGS. 1 and 2 The fins 26, 26'; 28, 28' primarily serve the purpose of accommodating expansion and contraction of a structure formed out of two or more panels 10 as discussed below. Preferably, two of the fins, i.e., fins 26' and 28' extend from the first and second ends walls 20, 30 at the point at which the walls 20, 30 intersect the second plate 16 of the panel 10 The fins 26', 28'0 are preferably bent in a direction toward the first plate 14.

The remaining two fins, 26 and 28 may extend from the first and second side walls 20, 30 at any point between the first and second plates 14, 16. However, it is preferred that the fins 26, 28 extend from the walls 20, 30 at some point transversely located between the channels 38, 40 to provide additional structural stability and for water drainage as described below. The fins 26, 28 are preferably bent in a direction toward the second plate 16.

When the connector 42 is in place interconnecting two adjacent panels **10, 10*a*, the fins 26, 26' of a first panel 10 should be pressed against and mated with the fins 28*a*, 28*a*' of a second panel 10*a* as shown in FIG. 2. When the fins 26, 26', 28*a*, 28*a*' are in contact in this manner, a passage 52 is created between the panels 10, 10*a* which serves as a drainage channel for unwanted condensation moisture and serves to seal the panels 10, 10*a*. A second passage 52' is formed between the connector 42 and the fins 26 and 28*a* between the panels 10, 10*a* which allows for silicone sealant. The pockets 52 and 52' together allow for panel expansion. If the panels 10, 10*a* are used for constructing a greenhouse or other similar structure which is exposed to rain or snow, water which is capable of leaking through the connector 42 does not penetrate to the interior of the structure, but is drained through the channels 38, 40**.

Two or more panels **10, 10*a* together with a connector 42 interconnecting the panels 10, 10*a* form a multi-panel structure 54 in accordance with the present invention as shown in FIG. 2. In a multiple panel structure 54 as shown in FIG. 2, the connector 42 useful for interlocking adjacent panels 10, 10*a* is preferably a slidable connector 42. However, snap-fit connectors and other possible designs known to those of ordinary skill in the art are within the scope of this invention as the design of the multiple void layer panels 10, 10*a* may be modified to accommodate other connection means. The connector 42 is preferably constructed of polycarbonate or other synthetic resin such as those suitable for construction of the panel 10. The connector may also be made of a more flexible material or reconfigured such that when the panels 10, 10*a* are connected as shown in FIG. 2, they do not have to be rigidly aligned at a 180° angle with one another, but may be slightly bent in the area around the connector 42 in order to allow for greater design flexibility between the panels 10, 10*a***.

The connector 42 preferably comprises a first and a second finger 68, 70. The first finger 68 is preferably sized to be disposed within the first channel 38 of panel 10 such that the first finger 68 is releasably secured within the first channel 38. The second finger 70 is preferably sized to be disposed within the second channel 40*a* of the adjacent panel 10*a* such that the second finger 70 is releasably secured within the channel 40*a*. The fingers 68, 70 have ends 72, 74 adapted to slide, for example, into the adjacent channels 38, 40*a* of two panels 10, 10*a* between the protrusions 46, 46*a* of the first plates 14, 14*a* of those panels 10, 10*a*. Preferably, the ends 72, 74 of the fingers 69, 70 do not completely fill the channels 38, 40*a* such that there is room for thermal expansion and drainage of unwanted water as described above.

The fingers 68, 70 are preferably interconnected by a base member 44. The base member 44 extends the length of the connector 42 and is generally rectangular in shape. Other geometric configurations are also acceptable; however, the base member 44 should be configured and adapted to bridge the distance between the channel 38 on the first panel 10 and the channel 40*a* on the adjacent panel 10*a* as shown in FIG. 2. The base member 44 preferably has a first surface 53 as shown in FIGS. 2 which extends outwardly from the base member. The extended first surface 53 should lie within the indentations 51 in the first plates 14, 14*a* such that the first surface 53 is substantially coplanar with the first plates 14, 14*a* of the panels 10, 10*a*. The base member 44 overlaps the space 56 between two panels 10, 10*a* as shown in FIG. 2.

The length of the surface 53 is preferably equal to the length of the base member 44. The extended surface 53 is adapted to slide or snap into facing engagement with the indentations 51 in the first plate 14. The width of the extended surface 53 measured transversely should be small enough that the surface 53 does not cover the full width of the indentations 51 in the first plate 14. Gaps 66 are thereby formed over the indentations 51 between the thick face of the first plate 14 and the extending surface 53 which allow for thermal expansion of the connector 42 and the panels 10, 10*a* and also contribute to inter-panel flexibility. While it is within the scope of the invention to provide a surface 53 which extends to fully cover the indentations 51, such a surface 53 is not preferred as there may be insufficient area for thermal expansion and inhibition of the flexibility of the connected panels 10, 10*a*.

A separate end piece 76 as shown in FIG. 2 is provided in accordance with the present invention which is adapted to fit in the channel 40 of the panel 10 of the present invention in the event the panel 10 is the end panel in any multi-panel structure 54 or if the panel 10 comprising channels 38, 40 is to be used as a single-panel wall not requiring connection to an adjacent panel. The end piece 76 resembles a portion of a connector 42. As shown in FIG. 2, the end piece 76 may be adapted to fit in either channel 38, 40 of a panel 10 in order to seal both channels in a single-panel wall or to seal a channel on the end panel of a multiple panel structure 54.

As shown in FIG. 2, the end piece 76 adapted for channel 40 has a single finger 78. This end piece 76 also comprises a base member 84 which is generally rectangular in shape. However, like the base member 44 of the connector 42, other geometric configurations are acceptable. The base member 84 is configured and adapted to bridge the distance between a side wall 28, 30 and the channel 38, 40 in which the finger 78 is to be inserted as shown in FIG. 2. The base member 84 preferably has one of its side surfaces 80 and 82 configured to smoothly align with one of the first and second side walls 20, 30 of the panel 10. The base member 84 of the end piece 76 has an extended top surface 86. The top surface 86 of the end piece 76 extends inwardly in a transverse direction toward the panel 10 on one side of the base member 84, and is adapted to slide or snap in facing engagement with an indentation 51 of the first plate 14 in the same manner as the extending surface 53 of the connector 42. The base member 84 should also be in facing engagement with one of the portions 48, 50 of the first plate 14 which lie between the channels 38, 40 and the side walls 20, 30 as shown in FIG. 2. The top surface 86 and the side surface 80, 82 which is aligned with a side wall 20, 30 should form an angle of about 90°, squaring off the corners of the panel 10 or the end channels 38, 40 of a multiple panel structure 54.

Panels 10 made in accordance with the present invention and interconnected in a multiple panel structure 54 may then be adapted, for example, in various skylight and greenhouse applications. The panels may be cut to any shape to adapt to various structural designs. In making such structures, a base frame, connection linkages and supports (not shown) may be provided to attach the ends of the multiple panel structure which are not interconnected to other panels to other construction materials and structures. Such frames, linkages and supports may be any which are known in the skylight and construction fields including, for example, without limitation, aluminum framing members, standard gaskets and sealing means, stainless steel or cadmium fasteners, gussets, gable posts, sill pans and flashing.

The panel of the present invention is preferably made by an extrusion method using a multiple port extrusion die which will be understood by those skilled in the art based upon this disclosure. The die must be specially made for this application and designed to accommodate a multiple void layer panel. Such a die is made by Sistemi Applicazioni Materie Plastiche (S.A.M.P., S.N.C.—di Cortellezzi & Soffiantini), Via Duca degli Abruzzi, 47, 21100 Varese, Italy and the extrusion process is performed using this die by Custom Extrusion, Inc. of Sheffield, Mass. Synthetic resin, preferably solid polycarbonate in cube or pelletized form available, for example, from General Electric Plastics, is fed into the feed hopper of a single-screw extruder (not shown). The solid resin is gravity fed from the hopper into the feed throat of the extruder. The barrel is heated from about 450° F. to about 525° F. to transform the solid feed into a semi-liquid mass which exits the extruder and is continuously conveyed into the multi-port extrusion die in a predetermined standard width adapted to a clamp ring on the extruder exit.

Upon exiting the die, the resin extrudate is roughly formed into the multiple void layer structure. As the structure exits the die, it is passed through a calibrator for sizing and support to maintain the structural integrity of the extruded panel while it is cooled. The calibrator support tooling is also made by S.A.M.P. in Italy, and, is preferably a water-cooled vacuum controlled device designed for continuous support in manufacturing the panel of the present invention. The calibrator, which fits around all sides of an extruded panel, pulls the extruded panel into shape while supporting and sizing the panel according to the particular manufacturing specifications. Cooling may be in accordance with any means known to those skilled in the art based upon this disclosure. Preferably the structure is air cooled and cut to any length based upon design requirements thereby forming the panel of the present invention.

The connector 42 and end pieces 76 are formed by the same method as the panel 10 but using a die available from Custom Extrusion, Inc. specially designed to mold the resin to the required dimensions of the connector 42 and end pieces 76.

This invention will now be illustrated in further detail by reference to the following non-limiting example.

EXAMPLE I

At a rate of 250 lbs/hr., approximately 40,000 lbs of ⅛" cubes of polycarbonate resin supplied by General Electric Plastics are gravity fed from an extruder hopper into a feed throat of an HPM Extruders single-screw continuous extruder. The barrel of the extruder operates at approximately 500° F. The semi-liquid mass exits the extruder at the exit clamp and is extruded through a heated S.A.M.P. multiple-port die configured to extrude a panel having four interior plates and five layers of cellular void spaces.

The panel is extruded in a length of 30 ft and a width of 2 ft. The overall extruded panel thickness measured 2⅝ in. The exterior and interior plates of the extruded panel have thicknesses of 0.048 in and 0.016 in respectively. The average void space extending the full length of the panel in each void layer have a thickness of ½ in and a width of 1 in.

After exiting the die, the structure is supported, calibrated and cooled to room temperature.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A light-transmissive panel comprising a unitary synthetic resin skeletal structure having a continuous length, the structure comprising:

(a) a first plate;

(b) a second plate generally parallel to and spaced apart from the first plate creating an interior space;

(c) at least two generally parallel, spaced apart interior plates located in the interior space between the first and second plates, such that the first, second and interior plates lie in planes generally parallel to each other along the length of the structure and a space is created between each pair of plates;

(d) a plurality of walls interconnecting the plates, the walls extending from the first plate to the second plate in a direction generally perpendicular to the planes of the plates, such that the plates and walls intersect forming a plurality of continuous cellular voids extending parallel to the length of the structure; and (e) a first channel near a first edge of the first plate defined by a portion of the first plate which protrudes inwardly into the interior space, wherein the first channel extends along the first edge of the structure in a direction parallel to the length of the structure, the first channel being adapted for receiving a connector and for connecting the panel to a panel juxtaposed to but spaced apart from the panel.

2. The panel according to claim 1, wherein the synthetic resin is selected from the group consisting of homopolymers, copolymers and terpolymers of polystyrene, polycarbonate, polyethylene, polypropylene and polyacrylate and homopolymers and copolymers of polyurethane and acrylonitrile-butadiene-styrene.

3. The panel according to claim 1, further comprising at least one layer of a light-transmissive protective polymeric material having an ultraviolet absorber adhered to an exterior surface of the first plate of the structure to minimize absorption of ultraviolet radiation and to prevent physical damage to the exterior surface.

4. The panel according to claim 3, wherein the protective polymeric material comprises a polymer selected from the group consisting of polycarbonate, polyethylene, polypropylene, polyacrylate and polyurethane.

5. The panel according to claim 3, wherein the ultraviolet absorber is selected from the group consisting of hydroxybenzophenones, 2,(2'-hydroxy-5'-methylphenyl)benzotriazole, 2,4-dihydroxybenzoylfuran, phenyl salicylate, resorcinol disalicylate, resorcinol benzoates, benzyl benzoate, stilbene, betamethylumbelliferone and betamethylumbelliferone benzoate.

6. The panel according to claim 1, comprising at least one protective layer of a light-transmissive polymeric material adhered to an exterior surface of the first plate to provide additional structural support to the panel.

7. The panel according to claim 6, wherein the protective polymeric material comprises a polymer selected from the group consisting of polycarbonate, polyethylene, polypropylene, polyacrylate and polyurethane.

8. The panel according to claim 1, wherein the panel comprises at least four interior plates.

9. The panel according to claim 1, wherein the first and second plates each have a thickness which is greater than a thickness of each interior plate, the thickness of each plate being measured in a direction perpendicular to the planes of the plates.

10. The panel according to claim 1, wherein each wall has a thickness measured in a direction parallel to the planes of the plates which is greater than a thickness of each interior plate measured in a direction perpendicular to the planes of the plates.

11. The panel according to claim 1, wherein a portion of the first plate protrudes inwardly into the interior space near a second edge of the first plate, such that the inwardly protruding portion of the first plate forms a second channel near the second edge, the second channel extending along the second edge of the structure in a direction parallel to the length of the structure to receive a connector such that the panel may be connected to at least one adjacent panel juxtaposed to but spaced apart from the panel.

12. The panel according to claim 1, wherein the panel comprises a predetermined width measured in a direction perpendicular to the length of the panel.

13. A structure comprised of at least one connector and at least two panels in accordance with claim 11, the panels arranged in juxtaposition such that a first edge of a first plate of a first panel in the structure is adjacent to but spaced apart from a second edge of a first plate of a second adjacent panel within the structure, wherein the connector is adapted to releasably engage a first channel of the first panel and a second channel of the second adjacent panel.

14. The structure of claim 13, wherein the connector comprises:

(a) a first finger sized to be disposed within the first channel of the first panel such that the first finger is releasably secured within the first channel of the first panel;

(b) a second finger sized to be disposed within the second channel of the second panel such that the second finger is releasably secured within the second channel of the second panel; and (c) a base member interconnected between the first finger and the second finger such that the first and second fingers are spaced from each other a distance which corresponds to a distance between the first channel of the first panel and the second channel of the second panel when the first and second panels are juxtaposed.

15. The structure of claim 14, wherein a first surface of the base member extends outwardly from the base member in a transverse direction along the length of the base member such that the first surface of the base member lies in a plane which is substantially coplanar with the first plate of the first panel and the first plate of the second panel.

16. A structure according to claim 13 wherein the first panel is an end panel, the structure further comprising a first end piece which comprises a finger sized to be disposed within a second channel of the first panel such that the finger is releasably secured within the second channel of the first panel and a base member connected to the finger such that the finger is spaced from a second edge of the first plate of the first panel a distance which corresponds to a distance between the second edge of the first plate and the second channel of the first panel.

17. The structure of claim 16, wherein a first surface of the base member of the first end piece extends outwardly from the base member in a transverse direction along a length of the base member away from the second edge of the first plate of the first panel such that the first surface of the base member of the first end piece is substantially coplanar with the first plate of the first panel.

18. A structure according to claim 13, wherein the second panel is an end panel, the structure further comprising a second end piece which comprises a finger sized to be disposed within a first channel of the second panel such that the finger is releasably secured within the first channel of the second panel and a base member connected to the finger such that the finger is spaced from a first edge of the first plate of the second panel a distance which corresponds to a distance between the first edge of the first plate and the first channel.

19. The structure of claim 18, wherein a first surface of the base member of the second end piece extends outwardly from the base member in a transverse direction along a length of the base member away from the first edge of the first plate of the second panel such that the first surface of the base member of the second end piece is substantially coplanar with the first plate of the second panel.

20. A light-transmissive panel comprising a unitary synthetic resin skeletal structure having a continuous length, the structure comprising:

(a) a first plate;

(b) a second plate generally parallel to and spaced apart from the first plate creating an interior space;

(c) at least two generally parallel, spaced apart interior plates located in the interior space between the first and second plates, such that the first, second and interior plates lie in planes generally parallel to each other along the length of the structure and a space is created between each pair of plates;

(d) a plurality of walls interconnecting the plates, the walls extending from the first plate to the second plate in a direction generally perpendicular to the planes of the plates, such that the plates and walls intersect forming a plurality of continuous cellular voids extending parallel to the length of the structure, a first side wall being connected to a first edge of the first plate;

(e) a first channel near the first edge of the first plate defined by a portion of the first plate which protrudes inwardly into the interior space, wherein the first channel extends along the edges of the structure in a direction parallel to the length of the structure, the first channel being adapted for receiving a connector and for connecting the panel to an adjacent panel juxtaposed to but spaced apart from the panel; and (f) a first pair of longitudinally extending bent fins extending outwardly from the first side wall for being juxtaposed to and forced against a corresponding second pair of fins on an adjacent panel for forming an enclosed hollow passage between the panel and the adjacent panel, the passage for allowing for thermal expansion, application of sealant and providing a means for sealing the panels to prevent water from passing completely through a space between the panel and the adjacent panel.

21. The panel according to claim 20, wherein the fins and the connector are constructed of a partially flexible polymeric material such that when the first and second panels are connected, they are not rigidly aligned at a 180° angle, but may be bent in the area around the connector for design flexibility.

* * * * *